US006440927B1

(12) United States Patent
Painter et al.

(10) Patent No.: US 6,440,927 B1
(45) **Date of Patent: *Aug. 27, 2002**

(54) MULTI-LAYER DETERGENT TABLET HAVING BOTH COMPRESSED AND NON-COMPRESSED PORTIONS

(75) Inventors: Jeffrey Donald Painter, Loveland, OH (US); Lynda Anne Speed, Gosforth (GB); Xiaoqing Song, West Chester; Peter Robert Foley, Cincinnati, both of OH (US); Sabine Ursula Metzger-Groom, Morpeth (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/554,205

(22) PCT Filed: Nov. 5, 1998

(86) PCT No.: PCT/US98/23614

§ 371 (c)(1),
(2), (4) Date: May 10, 2000

(87) PCT Pub. No.: WO99/24549

PCT Pub. Date: May 20, 1999

Related U.S. Application Data

(60) Provisional application No. 60/065,035, filed on Nov. 10, 1997.

(51) Int. Cl.[7] ..... C11D 17/00

(52) U.S. Cl. ..... 510/446; 510/224; 510/294; 510/298; 510/475; 510/505

(58) Field of Search ..... 510/224, 294, 510/298, 446, 475, 505

(56) References Cited

U.S. PATENT DOCUMENTS

| | | | | | |
|---|---|---|---|---|---|
| 4,460,490 | A | * | 7/1984 | Barford | 510/191 |
| 5,804,542 | A | | 9/1998 | Scheper et al. | |
| 5,858,117 | A | * | 1/1999 | Oakes et al. | 134/27 |
| 6,024,891 | A | * | 2/2000 | Hughes | 252/186.31 |

FOREIGN PATENT DOCUMENTS

| | | | | |
|---|---|---|---|---|
| DE | 2 9618136 | * | 12/1996 | |
| EP | 0 055 100 | A1 | 12/1981 | C11D/17/00 |
| EP | 0 224 135 | A2 | 11/1986 | C11D/17/00 |
| EP | 0 481 793 | A1 | 10/1991 | C11D/17/00 |
| GB | 1307387 | * | 2/1973 | |
| JP | 9-175992 | | 7/1997 | A61K/7/50 |
| WO | 92/20774 | * | 11/1992 | |
| WO | WO-97/00937 | A1 * | 1/1997 | |

* cited by examiner

*Primary Examiner*—Lorna M. Douyon
(74) *Attorney, Agent, or Firm*—Kevin L. Waugh; Brian M. Bolam

(57) ABSTRACT

A detergent tablet comprises: (a) a compressed solid body portion having at least one mold in the compressed body portion; and (b) a non-compressed, gelatinous portion integrally mounted in the mold of the compressed body portion, wherein the gelatinous portion comprising a thickening system and at least one detergent active. The thickening system preferably includes a non-aqueous diluent and a gelling agent and the detergent active is preferably selected from the group consisting of enzymes, surfactants, effervescing agents, bleaching agents, silver care agents, builders;, and mixtures thereof.

18 Claims, No Drawings

MULTI-LAYER DETERGENT TABLET HAVING BOTH COMPRESSED AND NON-COMPRESSED PORTIONS

This application is a 371 of PCT/US98/23614 filed Nov. 5, 1998 which claims the benefit of U.S. Provisional Application No. 60/065,035 filed Nov. 10, 1997.

TECHNICAL FIELD

The present invention relates to detergent tablets having multiple-layers and, more particularly, to multi-layer detergent tablets having both compressed and non-compressed portions.

BACKGROUND OF THE INVENTION

Detergent compositions in tablet form are known in the art. Detergent compositions in tablet form hold several advantages over detergent compositions in particulate or liquid form, such as ease of use and handling, convenient dosing, ease of transportation and storage. Due to these advantages, detergent compositions in tablet form are becoming increasingly popular with consumers of detergent products.

Detergent tablets are most commonly prepared by premixing the components and forming the pre-nixed components into a tablet via the use of a tablet press and compression of the components. However, traditional tablet compression processes have significant drawbacks, including but not limited to the fact that selected components of a detergent composition may be adversely affected by the compression pressure in the tablet press. Accordingly, these selected components were not typically included in prior art detergent tablets without sustaining a loss in performance. In some cases, these selected components may even have become unstable or inactive as a result of the compression.

In addition, as the components of the detergent composition are compressed in the tablet press, they are brought into close proximity with one another resulting in the reaction of selected component, instability, inactivity or exhaustion of the active form of the components.

To avoid the above mentioned drawbacks, prior art detergent tablets have attempted to separate components of the detergent composition that may potentially react with each other when the detergent composition is compressed into tablet form. Separation of the components has been achieved by, for example, preparing multiple-layer tablets wherein the reactive components are contained in different layers of the tablet or encapsulation and coating of reactive components. These prior art multiple-layer tablets are traditionally prepared using multiple compression steps. Accordingly, layers of the tablet which are subjected to more than one compression step may be subjected to a cumulative and potentially greater overall compression pressure. In addition, an increase in compression pressure of the tabletting press is known to decrease the rate of dissolution of the tablet with the effect that such multiple layer tablets may not dissolve satisfactorily in use. Nor is there any sinificant variation in the dissolution rates of the multiple layers.

Accordingly, the need remains for an improved detergent tablet, which can deliver active detergent ingredients to a domestic wash process thereby delivering superior performance benefits.

SUMMARY OF THE INVENTION

This need is met by the present invention wherein a multi-layer detergent tablet having a compressed body portion and a non-compressed gelatinous portion is provided. The tablet of the present invention provides a superior delivery mechanism for detergent components in addition to effectively separating potentially reactive ingredients. In addition, the detergent tablet of the present invention provides superior cleaning performance, particularly in domestic, automatic dishwashing machines over the tablets of the prior art.

According to a first embodiment of the present invention, a detergent tablet is provided. The tablet comprises:

A) a compressed solid body portion having at least one mold in the compressed body portion; and B) a non-compressed, gelatinous portion mounted in the mold of the compressed body portion, wherein the gelatinous portion comprises a thickening system and at least one detergent active.

Preferably, the gelatinous portion is formulated so that at least 80% of the detergent active is delivered to the wash within the first 5 minutes of a domestic wash process, and more preferably at least 90% of the detergent active is delivered to the wash within the first 3 minutes of a domestic wash process. The detergent active in the gel portion may be selected from the group consisting of enzymes, surfactants, disrupting agents, bleaching agents, silver care agents, builders, and mixtures thereof with enzymes and disrupting, agents being the most preferred. When a disrupting agent is included, the disrupting agent is preferably a salt of carbonate or bicarbonate and an organic acid.

In alternative preferred embodiments, the gel portion contains at least about 15% suspended solids and more preferably at least about 40% of the gelatinous portion is a suspended solid. The gelatinous portion may further includes a swelling/adsorbing agent.

The thickening system of the present invention preferably comprises a mixture of a non-aqueous diluent or solvent and a gelling agent. The gelling agent may be selected from the group consisting of castor oil derivatives polyethylene glycol and mixtures thereof and is preferably polyethylene glycol. The non-aqueous diluent may be selected from the group consisting of low molecular weight polyethylene glycols, glycerol and modified glycerols, propylene glycol, alkyleneglycol alkyl ethers and mixtures thereof and is preferably dipropyleneglycol butylether propylene glycol or glycerol triacetate.

Lastly, the weight ratio of the compressed portion to the non-compressed gelatinous portion is preferably greater than about 0.5:1 and the compressed portion of the detergent tablet preferably has a dissolution rate of greater than 0.33 g/min as determined using the SOTAX dissolution test method.

Accordingly, it is an object of the present invention to provide a multi-layer detergent tablet having at least one compressed portion and at least one non-compressed gelatinous portion. It is a further object of the present invention to provide a gel portion which can quickly and efficiently deliver detergent actives to a domestic wash process. It is still further an object of the present invention to provide a detergent tablet having a gel portion which is a pumpable, flowable solid at slightly elevated temperature yet hardens or thickens to maintain its form at ambient temperatures, particularly when shear is removed from the gel. These, and other objects, features and advantages of the present invention will be readily apparent to one of ordinary skill in the art from the following detailed description and the appended claims.

All percentages, ratios and proportions herein are by weight, unless otherwise specified. All temperatures are in degrees Celsius (° C.) unless otherwise specified. All documents cited are in relevant part, incorporated herein by reference.

DETAILED DESCRIPTION OF THE PREFERRED EMBODIMENTS

The present invention comprises a multi-phase detergent tablet and in particular a detergent tablet for automatic dishwashing which has a least one compressed body portion and a least one gelatinous or gel portion which is non-compressed. The use of the gel portion provides a superior delivery mechanism for detergent active agents into the domestic wash process. The gel portion provides unique properties of rapid dissolution or dispersion thereby providing for the earliest possible delivery of detergent active agents into the domestic wash process.

Accordingly, by way of the present invention, active detergent components of a detergent tablet previously adversely affected by the compression pressure used to form the tablets may now be included in a detergent tablet. Examples of these components include bleaching agents and enzymes. In addition, these active detergent components may be separated from one another by having one or more compatible components contained in the compressed portion and one or more compatible components contained in the non-compressed, gel portion of the tablet. Examples of components that may interact and may therefore require separation include bleaching agents, bleach activators or catalyst and enzymes; bleaching agents and bleach catalysts or activators; bleaching agents and surfactants; alkalinity sources, perfumes and enzymes.

It may be advantageous to provide the compressed and the non-compressed, gel portions such that they dissolve in the wash water with different dissolution rates. By controlling the rate of dissolution of each portion relative to one another, and by selection of the active detergent components in the respective portions, their order of release into the wash water can be controlled and the cleaning performance of the detergent tablet may be improved. For example it is often preferred that enzymes are delivered to the wash prior to builders and/or bleaching agent and/or bleach activator. It may also be preferred that a source of alkalinity is released into the wash water more rapidly than other components of the detergent tablet. It is also envisaged that it may be advantageous to prepare a detergent tablet according to the present invention wherein the release of certain components of the tablet is delayed relative to other components.

The tablet may also comprise a plurality of compressed or non-compressed, gel portions. For example, a plurality of compressed portions may be arranged in layers and/or a plurality of non-compressed portions may be present as discrete sections of the tablet separated by a compressed portion. Thus, there may be a first and a second and optional subsequent compressed and/or non-compressed, gel portions, each comprising an active detergent component and where at least the first and second portions may comprise different active detergent components or mixtures of components. Such a plurality of compressed or non-compressed, gel portions may be advantageous, enabling a tablet to be produced which has for example, a first and second and optional subsequent portions so that they have different rates of dissolution. Such performance benefits are achieved by selectively delivering active detergent components into the wash water at different times.

The compressed portion of the detergent tablets described herein are preferably between 15 g and 100 g in weight, more preferably between 18 g and 80 g in weight, even more preferably between 20 g and 60 g in weight. The detergent tablet described herein that are suitable for use in automatic dishwashing methods are most preferably between 20 g and 40 g in weight. Detergent tablets suitable for use in fabric laundering methods are most preferably between 40 g and 100 g, more preferably between 40 g and 80 g. most preferably between 40 g and 65 g in weight. The weight ratio of compressed portion to non-compressed, gel portion is generally greater than 0.5:1, preferably greater than 1:1, more preferably greater than 2:1, even more preferably greater than 3:1 or even 4:1. most preferably at least 5:1.

The compressed portion of the detergent tablets described herein, have Child Bite Strength (CBS) which is generally greater than 10 Kg, preferably greater than 12 Kg. most preferably greater than 14 Kg. CBS is measured as per the U.S. Consumer Product Safety Commission Test Specification.

Child Bite Strength Test Method: According,to this method the tablet is placed horizontally between two strips/plates of metal. The upper and lower plates are hinged on one side, such that the plates resemble a human jaw. An increasing downward force is applied to the upper plate, mimicking the closing action of the jaw, until the tablet breaks. The CBS of the tablet is a measure of the force in Kilograms, required to break the tablet.

The compressed portions of the detergent tablets described herein generally have a dissolution rate of faster than 0.33 g/min, preferably faster than 0.5 g/min, more preferably faster than 1.00 g/min, even more preferably faster than 2.00 g/m, most preferably faster than 2.73 g/min. Dissolution rate is measured using the SOTAX dissolution test method. For the purposes of the present invention dissolution of detergent tablets is achieved using a SOTAX (tradename) machine; model number AT7 available from SOTAX.

SOTAX Dissolution Test Method: The SOTAX machine consists of a temperature controlled waterbath with lid. 7 pots are suspended in the water bath. 7 electric stirring rods are suspended from the underside of the lid, in positions corresponding to the position of the pots in the waterbath. The lid of the waterbath also serves as a lid on the pots.

The SOTAX waterbath is filled with water and the temperature gauge set to 50° C. Each pot is then filled with 1 liter of deionised water and the stirrer set to revolve at 250 rpm. The lid of the waterbath is closed, allowing the temperature of the deionised water in the pots to equilibrate with the water in the waterbath for 1 hour.

The tablets are weighed and one tablet is placed in each pot, the lid is then closed. The tablet is visually monitored until it completely dissolves. The time is noted when the tablet has completely dissolved. The dissolution rate of the tablet is calculated as the average weight (g) of tablet dissolved in deionised water per minute.

Compressed Portion

The compressed portion of the detergent tablet comprises at least one active detergent component but may comprise a mixture of more than one active detergent components, which are compressed. Any detergent tablet component conventionally used in known detergent tablets is suitable for incorporation into the compressed portion of the detergent tablets of this invention. Suitable active detergent components are described hereinafter. Preferred active detergent components include builder compound, surfactant, bleaching agent bleach activator, bleach catalyst, enzyme and an alkalinity source.

Active detergent component(s) present in the compressed layer may optionally be prepared in combination with a carrier and/or a binder for example water, polymer (e.g. PEG), liquid silicate. The active detergent components are preferably prepared in particulate form (i.e. powder, or granular form) and may be prepared by any known method, for example conventional spray drying, granulation or agglomeration. The particulate active detergent component (s) are then compressed using any suitable equipment suitable for forming compressed tablets, blocks, bricks or briquettes; described in more detail hereafter.

In preferred embodiments the compressed body portion has at least one indentation, depression or mold on a surface of the compressed body portion. This indentation or mold acts as a reservoir for the gel portion during manufacture of the detergent tablet.

The compressed body portion may also be provided with a coating of a water-soluble material to protect the body portion. The coating layer preferably comprises a material that becomes solid on contacting the compressed and/or the non-compressed portions within preferably less than 15 minutes, more preferably less than 10 minutes, even more preferably less than 5 minutes, most preferably less than 60 seconds. Preferably the coating layer is water-soluble. Preferred coating layers comprise materials selected from the group consisting of fatty acids, alcohols, diols, esters and ethers, adipic acid, carboxylic acid, dicarboxylic acid, polyvinyl acetate (PVA), polyvinyl pyrrolidone (PVP), polyacetic acid (PLA), polyethylene glycol (PEG) and mixtures thereof. Preferred carboxylic or dicarboxylic acids preferably comprise an even number of carbon atoms. Preferably carboxylic or dicarboxylic acids comprise at least 4, more preferably at least 6, even more preferably at least 8 carbon atoms, most preferably between 8 and 13 carbon atoms. Preferred dicarboxylic acids include adipic acid, suberic acid, azelaic acid, subacic acid, undecanedioic acid, dedecanedioic acid, tridecanedioic and mixtures thereof. Preferred fatty acids are those having a carbon chain length of from C12 to C22, most preferably from C18 to C22. The coating layer may also preferably comprise a disrupting agent. Where present the coating layer generally present at a level of at least 0.05%, preferably at least 0.1%, more preferably at least 1%, most preferably at least 2% or even at least 5% of the detergent tablet.

Gel-Portion

As noted earlier, a gel portion is mounted or formed onto the compressed body portion of the detergent tablet and preferably into an indentation formed on the compressed body portion. The gel portion comprises a thickening system and at least one detergent active agent. The gel-portion is preferably formulated such that the detergent active ingredient is essentially completely delivered in a short period of time. Typically, the gel portion is formulated so that at least about 80% of the detergent active is delivered to the wash of a domestic washing process within the first 5 minutes, more preferably at least about 90% in the first 3 minutes and even more preferably 95% within the first 2 minutes as measured from the first point at which the tablet including the gel portion is completely immersed in water, particularly in cold water temperatures, such as, e.g., 25° C. Thus, the tablet of the present invention is particularly effective at delivering detergent actives in varying water temperatures including cold water.

The gel portion may include solid ingredients which are dispersed or suspended within the gel. The solid ingredients aid in the control of the viscosity of the gel formulation in conjunction with the thickening system. In addition, solid ingredients may act to optionally disrupt the gel thereby aiding in dissolution of the gel portion. When included, the gel portion typically comprises at least about 15% solid ingredients, more preferably at least about 30% solid ingredients and most preferably at least about 40% solid ingredients. However, due to pumpability and other processing concerns, the gel portions of the present invention typically do not include more than about 90% solid ingredients.

Thickening System

As noted earlier, the detergent tablet of the present invention comprises thickening system in the gelatinous portion to provide the proper viscosity or thickness of the gel portion. The thickening system typically comprises a non-aqueous liquid diluent and an organic or polymeric gelling additive a) Liquid Diluent The term "solvent" or "diluent" is used herein to connote the liquid portion of the thickening system. While some of the essential and/or optional components of the compositions herein may actually dissolve in the "solvent"-containing phase. other components will be present as particulate material dispersed within the "solvent"-containing phase. Thus the term "solvent" is not meant to require that the solvent material be capable of actually dissolving all of the detergent composition components added thereto. Suitable types of solvents useful in the non-aqueous thickening systems herein include alkylene glycol mono lower alkyl ethers, propylene glycols, ethoxylated or propoxylated ethylene or propylene, glycerol esters, glycerol triacetate, lower molecular weight polyethylene glycols, lower molecular weight methyl esters and amides, and the like.

A preferred type of non-aqueous solvent for use herein comprises the mono-, di-, tri-, or tetra-$C_2$–$C_3$ alkylene glycol mono $C_2$–$C_6$ alkyl ethers. The specific examples of such compounds include diethylene glycol monobutyl ether, tetraethylene glycol monobutyl ether, dipropylene glycol monoethyl ether, and dipropylene glycol monobutyl ether, Diethylene glycol monobutyl ether and dipropylene glycol monobutyl ether are especially preferred. Compounds of the type have been commercially marketed under the tradenames Dowanol, Carbitol, and Cellosolve.

Another preferred type of non-aqueous solvent useful herein comprises the lower molecular weight polyethylene glycols (PEGs). Such materials are those having molecular weights of at least about 150. PEGs of molecular weight ranging from about 200 to 600 are most preferred.

Yet another preferred type of non-aqueous solvent comprises lower molecular weight methyl esters. Such materials are those of the general formula: $R^1$—C(O)—$OCH_3$ wherein $R^1$ ranges from 1 to about 18. Examples of suitable lower molecular weight methyl esters include methyl acetate, methyl propionate, methyl octanoate, and methyl dodecanoate.

The non-aqueous organic solvent(s) employed should, of course, be compatible and non-reactive with other composition components, e.g., enzymes, used in the detergent tablets herein. Such a solvent component will generally be utilized in an amount of from about 10% to 60% by weight of the gel portion. More preferably, the non-aqueous low-polarity organic solvent will comprise: from about 20% to 50%, by weight of the gel portion, most preferably from about 30% to 50% by weight of the gel portion.

b) Gelling Additive

As noted earlier, a gelling a agent or additive is added to the non aqueous solvent of the present invention to complete the thickening system. To form the gel required for suitable phase stability and acceptable rheology of the gel portion, the organic gelling agent is generally present to the extent of a ratio of solvent to gelling agent in thickening system typically ranging from about 99:1 to about 1:1. More preferably, the ratios range from about 19:1 to about 4:1.

The preferred gelling agents of the present invention are selected from castor oil derivatives, polyethylene glycol, sorbitols and related organic thixatropes, organoclays, cellulose and cellulose derivatives, pluronics, stearates and stearate derivatives, sugar/gelatin combination, starches, glycerol and derivatives thereof, organic acid amides such as N-lauryl-L-glutamic acid di-n-butyl amide, polyvinyl pyrrolidone and mixtures thereof.

The preferred gelling agents include castor oil derivatives. Castor oil is a naturally occurring triglyceride obtained from the seeds of Ricinus Communis, a plant which grows in most tropical or subtropical areas. The primary fatty acid moiety in the castor oil triglyceride is ricinoleic acid (12-hydroxy oleic acid). It accounts for about 90% of the fatty acid moieties. The balance consists of dihydroxystearic, palmitic, stearic, oleic, linoleic, linolenic and eicosanoic moieties. Hydrogenation of the oil (e.g., by hydrogen under pressure) converts the double bonds in the fatty acid moieties to single bonds, thus "hardening" the oil. The hydroxyl groups are unaffected by this reaction.

The resulting hydrogenated castor oil, therefore, has an average of about three hydroxyl groups per molecule. It is believed that the presence of these hydroxyl groups accounts in large part for the outstanding structuring properties which are imparted to the gel portion compared to similar liquid, detergent compositions which do not contain castor oil with hydroxyl groups in their fatty acid chains. For use in the compositions of the present invention the castor oil should be hydrogenated to an iodine value of less than about 20, and preferably less than about 10. Iodine value is a measure of the degree of unsaturation of the oil and is measured by the "Wijis Method," which is well-known in the art. Unhydrogenated castor oil has an iodine value of from about 80 to 90.

Hydrogenated castor oil is a commercially available commodity being sold, for example, in various grades under the trademark CASTORWAX.RTM. by NL Industries, Inc., Highstown, N.J. Other Suitable hydrogenated castor oil derivatives are Thixcin R, Thixcin E, Thixatrol ST, Perchem R and Perchem ST, made by Rheox, Laporte. Especially preferred is Thixatrol ST.

Polyethylene glycols when employed as gelling agents, rather than solvents, are low molecular weight materials, having a molecular weight range of from about 1000 to about 10,000, with 3,000 to 8,000 being the most preferred.

Cellulose and cellulose derivatives when employed in the present invention preferably include: i) Cellulose acetate and Cellulose acetate phthalate(CAP); ii) Hydroxypropyl Methyl Cellulose (HPMC); iii)Carboxymethylcellulose (CMC); and mixtures thereof. The hydroxypropyl methylcellulose polymer preferably has a number average molecular weight of about 50,000 to 125,000 and a viscosity of a 2 wt. % aqueous solution at 25° C. (ADTMD2363) of about 50,000 to about 100,000 cps. An especially preferred hydroxypropyl cellulose polymer is Methocel® J75MS-N wherein a 2.0 wt. % aqueous solution at 25° C. has a viscosity of about 75,000 cps.

The sugar may be any monosaccharide (e.g. glucose), disaccharide (e.g. sucrose or maltose) or polysaccharide. The most preferred sugar is commonly available sucrose. For the purposes of the present invention type A or B gelatin may be used, available from for example Sigma. Type A gelatin is preferred since it has greater stability in alkaline conditions in comparison to type B. Preferred gelatin also has a bloom strength of between 65 and 300, most preferably between 75 and 100.

The gel portion of the present invention may include a variety of other ingredients in addition to the thickening agent as herein before described and the detergent active disclosed in more detail below. Ingredients such as perfumes and dyes may be included as well as structure modifying agents. Structure modifying agents include various polymers and mixtures of polymers included polycarboxylates, carboxymethylcelluloses and starches to aid in adsorption of excess solvent and/or reduce or prevent "bleeding" or leaking of the solvent from the gel portion, reduce shrinkage or cracking of the gel portion or aid in the dissolution or breakup of the gel portion in the wash. In addition, hardness modifying agents may incorporated into the thickening system to adjust the hardness of the gel if desired. These hardness control agents are typically selected from various polymers, such as polyethylene glycol's, polyethylene oxide, polyvinylpyrrolidone, polyvinyl alcohol, hydroxystearic acid and polyacetic acid and when included are typically employed in levels of less than about 20% and more preferably less than about 10% by weight of the solvent in the thickening system.

The gel portion of the present invention is formulated so that the gel is a pumpable, flowable gel at slightly elevated temperatures of around 30° C. or greater to allow increased flexibility in producing the detergent tablet, but becomes highly viscous or hardens at ambient temperatures so that the gel is maintained in position on the compressed body portion of the detergent tablet through shipping and handling of the detergent tablet. Such hardening of the gel portion may achieved, for example by (i) cooling to below the flowable temperature of the gel or the removal of shear; (ii) by solvent transfer, for example either to the atmosphere of the compressed body portion; or by (iii) by polymerisation of the gelling agent. Preferably, the gel portion is formulated such that the gel hardens to sufficiently so that the maximum force needed to push a probe into the dimple preferably ranges from about 0.5N to about 40N. This force may be characterised by measuring the maximum force needed to push a probe, fitted with a strain gauge, a set distance into the gel. The set distance may be between 40 and 80% of the total gel depth. This force can be measured on a QTS 25 tester, using a probe of 5 mm diameter. Typical forces measured are in the range of 1N to 25N.

The detergent tablet of the present invention is manufactured in according to a process wherein.

Detergent Actives

Both the gel-portion and the compressed portion of the present invention detergent tablet include at least one detergent active. The gel-portion typically contains detergent actives such as surfactants, enzymes, bleaching agents, effervescing agents, silver care agents, builders and the like. The compressed portion typically contains detergent actives such as builders, surfactants, silicates, pH control agents or buffers, enzymes and bleaching agents. The following is a description of the detergent actives useful in the present invention.

Surfactants

Detersive surfactants included in the fully-formulated detergent compositions afforded by the present invention comprises at least 0.01%, preferably from about 0.5% to about 50%, by weight of detergent composition depending upon the particular surfactants used and the desired effects. In a highly preferred embodiment, the detersive surfactant comprises from about 0.5% to about 20% by weight of the composition.

The detersive surfactant can be nonionic, anionic, ampholytic, zwitterionic, or cationic. Mixtures of these surfactants can also be used. Preferred detergent compositions comprise anionic detersive surfactants or mixtures of anionic surfactants with other surfactants, especially nonionic surfactants.

Nonlimiting examples of surfactants useful herein include the conventional $C_{11}$–$C_{18}$ alkyl benzene sulfonates and primary, secondary and random alkyl sulfates, the $C_{10}$–$C_{18}$ alkyl alkoxy sulfates, the $C_{10}$–$C_{18}$ alkyl polyglycosides and their corresponding sulfated polyglycosides, $C_{12}$–$C_{18}$ alpha-sulfonated fatty acid esters, $C_{12}$–$C_{18}$ alkyl and alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like. Other conventional useful surfactants are listed in standard texts.

Particularly preferred surfactants in the preferred automatic dishwashing compositions (ADD) of the present invention are low foaming nonionic surfactants (LFNI). LFNI may be present in amounts from 0.01% to about 10% by weight, preferably from about 0.1% to about 10%, and most preferably from about 0.25% to about 4% LFNIs are most typically used in ADDs on account of the improved water-sheeting action (especially from glass) which they confer to the ADD product. They also encompass non-silicone, nonphosphate polymeric materials further illustrated hereinafter which are known to defoam food soils encountered in automatic dishwashing.

Preferred LFNIs include nonionic alkoxylated surfactants, especially ethoxylates derived from primary alcohols, and blends thereof with more sophisticated surfactants, such as the polyoxypropylene/polyoxyethylene/polyoxypropylene (PO/EO/PO) reverse block polymers. The PO/EO/PO polymer-type surfactants are well-known to have foam suppressing or defoaming action, especially in relation to common food soil ingredients such as egg.

The invention encompasses preferred embodiments wherein LFNI is present, and wherein this component is solid at about 95° F. (35° C.), more preferably solid at about 77° F. (25° C.). For ease of manufacture, a preferred LFNI has a melting point between about 77° F. (25° C.) and about 140° F. (60° C.), more preferably between about 80° F. (26.6° C.) and 110° F. (43.3° C.).

In a preferred embodiment, the LFNI is an ethoxylated surfactant derived from the reaction of a monohydroxy alcohol or alkylphenol containing from about 8 to about 20 carbon atoms, with from about 6 to about 15 moles of ethylene oxide per mole of alcohol or alkyl phenol on an average basis.

A particularly preferred LFNI is derived from a straight chain fatty alcohol containing from about 16 to about 20 carbon atoms ($C_{16}$–$C_{20}$ alcohol), preferably a $C_{18}$ alcohol, condensed with an average of from about 6 to about 15 moles, preferably from about 7 to about 12 moles, and most preferably from about 7 to about 9 moles of ethylene oxide per mole of alcohol. Preferably the ethoxylated nonionic surfactant so derived has a narrow ethoxylate distribution relative to the average.

The LFNI can optionally contain propylene oxide in an amount up to about 15% by weight. Other preferred LFNI surfactants can be prepared by the processes described in U.S. Pat. No. 4223,163 issued Sep. 16. 1980. Builloty, incorporated herein by reference.

Highly preferred ADDs herein wherein the LFNI is present make use of ethoxylated monohydroxy alcohol or alkyl phenol and additionally comprise a polyoxyethylene, polyoxypropylene block polymeric compound; the ethoxylated monohydroxy, alcohol or alkyl phenol fraction of the LFNI comprising from about 20% to about 100%, preferably from about 30% to about 70%, of the total LFNI.

Suitable block polyoxyethylene-polyoxypropylene polymeric compounds that meet the requirements described hereinbefore include those based on ethylene glycol, propylene glycol, glycerol, trimethylolpropane and ethylenediamine as initiator reactive hydrogen compound. Polymeric compounds made from a sequential ethoxylation and propoxylation of initiator compounds with a single reactive hydrogen atom, such as $C_{12\text{-}18}$ aliphatic alcohols do not generally provide satisfactory suds control in the instant ADDs. Certain of the block polymer surfactant compounds designated PLURONIC(D and TETRONICO by the BASF-Wyandotte Corp., Wyandotte, Mich., are suitable in ADD compositions of the invention.

A particularly preferred LFNI contains from about 40% to about 70% of a polyoxypropylene/polyoxyethylene/polyoxypropylene block polymer blend comprising about 75%, by weight of the blend, of a reverse block co-polymer of polyoxyethylene and polyoxypropylene containing 17 moles of ethylene oxide and 44 moles of propylene oxide; and about 25%, by weight of the blend, of a block co-polymer of polyoxyethylene and polyoxypropylene initiated with trimethylolpropane and containing 99 moles of propylene oxide and 24 moles of ethylene, oxide per mole of trimethylolpropane.

Suitable for use as LFNI in the ADD compositions are those LFNI having relatively low cloud points and high hydrophilic-lipophilic balance (HLB). Cloud points of 1% solutions in water are typically below about 32° C. and preferably lower, e.g., 0° C., for optimum control of sudsing throughout a full range of water temperatures.

LFNIs which may also be used include those POLY-TERGENT® SLF-18 nonionic surfactants from Olin Corp., and any biodegradable LFNI having the melting point properties discussed hereinabove.

These and other nonionic surfactants are well known in the art, being described in more detail in Kirk Othmer's Encyclopedia of Chemical Technology, 3rd Ed. Vol. 22, pp. 360–379, "Surfactants and Detersive Systems", incorporated by reference herein.

Preferred are ADD compositions comprising mixed surfactants wherein the sudsing (absent any silicone suds controlling agent) is less than 2 inches, preferably less than 1 inch, as determined by the disclosure below.

The equipment useful for these measurements are: a Whirlpool Dishwasher (model 900) equipped with clear plexiglass door, IBM computer data collection with Labview and Excel Software, proximity sensor (Newark Corp.—model 95F5203) using SCXI interface, and a plastic ruler.

The data is collected as follows. The proximity sensor is affixed to the bottom dishwasher rack on a metal bracket. The sensor faces downward toward the rotating dishwasher arm on the bottom of the machine (distance approximately 2 cm. from the rotating arm). Each pass of the rotating arm is measured by the proximity sensor and recorded. The pulses recorded by the computer are converted to rotations per minute (RPM) of the bottom arm by counting pulses over a 30 second interval. The rate of the arm rotation is directly proportional to the amount of suds in the machine and in the dishwasher pump (i.e., the more suds produced, the slower the arm rotation).

The plastic ruler is clipped to the bottom rack of the dishwasher and extends to the floor of the machine. At the end of the wash cycle, the height of the suds is measured using the plastic ruler (viewed through the clear door) and recorded as suds height.

The following procedure is followed for evaluating ADD compositions for suds production as well as for evaluating nonionic surfactants for utility. (For separate evaluation of nonionic surfactant, a base ADD formula, such as Cascade powder, is used along with the nonionic surfactants which are added separately in glass vials to the dishwashing machine.).

First, the machine is filled with water (adjust water for appropriate temperature and hardness) and proceed through a rinse cycle. The RPM is monitored throughout the cycle (approximately 2 min.) without any ADD product (or surfactants) being added (a quality control check to ensure the machine is functioning properly). As the machine begins to fill for the wash cycle, the water is again adjusted for temperature and hardness, and then the ADD product, is added to the bottom of the machine (in the case of separately evaluated surfactants, the ADD base formula is first added to the bottom of the machine then the surfactants are added by placing the surfactant-containing glass vials inverted on the top rack of the machine). The RPM is then monitored throughout the wash cycle. At the end of the wash cycle the suds height is recorded using the plastic ruler. The machine is again filled with water (adjust water for appropriate temperature and hardness) and runs through another rinse cycle. The RPM is monitored throughout this cycle.

An amperage RPM is calculated for the 1st rinse, main wash, and final rinse. The % RPM efficiency is then calculated by dividing the average RPM for the test surfactants into the average RPM for the control system (base ADD formulation without the nonionic surfactant). The RPM efficiency and suds height measurements are used to dimension the overall suds profile of the surfactant.

Detergent Builders

The present invention may include an optional builder in the product composition. The level of deterrent salt/builder can vary widely depending upon the end use of the composition and its desired physical form. When present, the compositions will typically comprise at least about 1% detergent builder and more typically from about 10% to about 80%, even more typically from about 15% to about 50% by weight, of the detergent builder. Lower or higher levels, however, are not meant to be excluded.

Inorganic or P-containing detergent builders include, but are not limited to, the alkali metal, ammonium and alkanolammonium salts of polyphosphates (exemplified by the tripolyphosphates, pyrophosphates, and glassy polymeric metaphosphates), phosphonates, phytic acid, silicates, carbonates (including bicarbonates and sesquicarbonates), sulphates, and aluminosilicates. However, non-phosphate salts are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}\cdot yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta aid gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate salts as builders are the alkaline earth and alkali metal carbonates as disclosed in German Patent Application No. 2,321,001 published on Nov. 15, 1973.

Aluminosilicate builders may also be added to the present invention as a detergent salt. Aluminosilicate builders are of great importance in most currently marketed heavy duty granular detergent compositions. Aluminosilicate builders include those having the empirical formula:

$$M_z(zAlO_2)_y]\cdot xH_2O$$

wherein z and v are integers of at least 6. the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al. issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}]\cdot xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,063,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635, 4,120,874 and 4,102,903.

Other useful detergency builders include the ether hydroxypolycarboxylates, copolymers of maleic anhydride with ethylene or vinyl methyl ether. 1, 3, 5-trihydroxy benzene-2, 4, 6-trisulphonic acid, and carboxymethyloxysuccinic acid, the various alkali metal, ammonium and substituted ammonium salts of polyacetic acids such as ethylenediamine tetraacetic acid and nitrilotriacetic acid as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application No. 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

Bleaching, Agents

Bleaching agents according to the present invention may include both chlorine and oxygen bleaching systems. Hydrogen peroxide sources are described in detail in the herein incorporated Kirk Othmer's Encyclopedia of Chemical Technology. 4th Ed (1992, John Wiley & Sons), Vol. 4, pp. 271–300 "Bleaching Agents (Survey)", and include the various forms of sodium perborate and sodium percarbonate, including various coated and modified forms. An "effective amount" of a source of hydrogen peroxide is any amount capable of measurably improving stain removal (especially of tea stains) from soiled dishware compared to a hydrogen peroxide source-free composition when the soiled dishware is washed by the consumer in a domestic automatic dishwasher in the presence of alkali.

More generally a source of hydrogen peroxide herein is any convenient compound or mixture which under consumer use conditions provides an effective amount of hydrogen peroxide. Levels may vary widely and are usually in the range from about 0.1% to about 70%, more typically from about 0.5% to about 30%, by weight of the compositions herein.

The preferred source of hydrogen peroxide used herein can be any convenient source, including hydrogen peroxide itself. For example, perborate, e.g., sodium perborate (any hydrate but preferably the mono- or tetra-hydrate), sodium carbonate peroxyhydrate or equivalent percarbonate salts, sodium pyrophosphate peroxyhydrate, urea peroxyhydrate, or sodium peroxide can be used herein. Also useful are sources of available oxygen such as persulfate bleach (e.g., OXONE, manufactured by DuPont). Sodium perborate monohydrate and sodium percarbonate are particularly preferred. Mixtures of any convenient hydrogen peroxide sources can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with a silicate, borate or water-soluble surfactants. Percarbonate is available from various commercial sources such as FMC, Solvay and Tokai Denka.

While not preferred for compositions of the present invention which comprise detersive enzymes, the present invention compositions may also comprise as the bleaching agent a chlorine-type bleaching material. Such agents are well known in the art and include for example sodium dichloroisocyanurate ("NaDCC").

(a) Bleach Activators

Preferably, the peroxygen bleach component in the composition is formulated with an activator (peracid precursor). The activator is present at levels of from about 0.01% to about 15%, preferably from about 0.5% to about 10%, more preferably from about 1% to about 8%, by weight of the composition. Preferred activators are selected from the group consisting of tetraacetyl ethylene diamine (TAED), benzoylcaprolactam (BzCL), 4-nitrobenzoylcaprolactam, 3-chlorobenzoyl-caprolactam, benzoyloxybenzenesulphonate (BOBS), nonanoyloxybenzene-sulphonate (NOBS), phenyl benzoate (PLBz), decanoyloxybenzenesulphonate ($C_{10}$–OBS), benzoylvalerolactam (BZVL), octanoyloxybenzenesulphonate, ($C_8$-OBS), perhydrolyzable esters and mixtures thereof, most preferably benzoylcaprolactam and benzoylvalerolactam. Particularly preferred bleach activators in the pH range from about 8 to about 9.5 are those selected having an OBS or VL leaving group.

Preferred bleach activators are those described in U.S. Pat. No. 5,130,045, Mitchell et al. and U.S. Pat. No. 4,412,934. Chung et al, and copending patent applications U.S. Ser. Nos. 08/064,624, 08/064,623, 08/064.621, 08/064,562, 08/064,564, all abandonded and copendings application to M. Burns, A. D. Willey, R. T. Hartshorn, C. K. Ghosh. entitled "Bleaching Compounds Comprising Peroxyacid Activators Used With Enzymes" and having U.S. Ser. No. 08/133,691 (P&G Case 4890R), now abandonded all of which are incorporated herein by reference.

The mole ratio of peroxygen bleaching compound (as AvO) to bleach activator in the present invention generally ranges from at least 1:1, preferably from about 20:1 to about 1:1, more preferably from about 10:1 to about 3:1.

Quaternary substituted bleach activators may also be included. The present detergent compositions preferably comprise a quaternary substituted bleach activator (QSBA) or a quaternary substituted peracid (QSP); more preferably, the former. Preferred QSBA structures are further described in copending U.S. Pat. Nos. 5,460,747, 5,584,888 and 5,578,136, incorporated herein by reference.

(b) Organic Peroxides, especially Diacyl Peroxides

These are extensively illustrated in Kirk Othmer, Encyclopedia of Chemical Technology, Vol. 17, John Wiley and Sons, 1982 at pages 27–90 and especially at pages 63–72, all incorporated herein by reference. If a diacyl peroxide is used, it will preferably be one which exerts minimal adverse impact on spotting/filming. Preferred is dibenzoyl peroxide.

(c) Metal-containing Bleach Catalysts

The present invention compositions and methods utilize metal-containing bleach catalysts that are effective for use in ADD compositions. Preferred are manganese and cobalt-containing bleach catalysts.

One type of metal-containing bleach catalyst is a catalyst system comprising a transition metal cation of defined bleach catalytic activity, such as copper, iron, titanium, ruthenium tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra (methylenephosphonic acid) and water-soluble salts thereof. Such catalysts are disclosed in U.S. Pat. No. 4,430,243.

Other types of bleach catalysts include the manganese-based complexes disclosed in U.S. Pat. Nos. 5,246,621 and 5,244,594. Preferred examples of theses catalysts include $Mn^{IV}_2(u\text{-}O)_3$(1,4,7-trimethyl-1,4,7-triazacyclononane)$_2$-$(PF_6)_2$ ("MnTACN"), $Mn^{III}_2(u\text{-}O)_1(u\text{-}OAc)_2$(1,4,7-trimethyl-1,4,7-triazacyclononane)$_2$-$(ClO_4)_2$, $Mn^{IV}_4(u\text{-}O)_6$(1,4,7-triazacyclononane)$_4$-$(ClO_4)_2$, $Mn^{III}Mn^{IV}_4(u\text{-}O)_1(u\text{-}OAc)_2$(1,4,7-trimethyl-1,4,7-triazacyclononane)$_2$-$(ClO_4)_3$, and mixtures thereof. See also European patent application publication No. 549,272. Other ligands suitable for use herein include 1,5,9-trimethyl-1,5,9-triazacyclononane, 2-methyl-1,4,7-triazacyclononane, 2-methyl-1,4,7-triazacyclononane, and mixtures thereof.

The bleach catalysts useful in automatic dishwashing compositions and concentrated powder detergent compositions may also be selected as appropriate for the present invention. For examples of suitable bleach catalysts see U.S. Pat. Nos. 4,246,612 and 5,227,084.

Other bleach catalysts are described, for example, in European patent application, publication No. 408,131 (cobalt complex catalysts), European patent applications, publication Nos. 384,503, and 306,089 (metallo-porphyrin catalysts), U.S. Pat. No. 4,728,455 (manganese/multidentate ligand catalyst), U.S. Pat. No. 4,711,748 and European patent application, publication No. 224,952, (absorbed manganese on aluminosilicate catalyst), U.S. Pat. No. 4,601,845 (aluminosilicate support with manganese and zinc or magnesium salt), U.S. Pat No. 4,626,373 (manganese/ligand catalyst), U.S. Pat. No. 4,119,557 (ferric complex catalyst), German Pat. specification No. 2,054,019 (cobalt chelant catalyst) Canadian 866,191 (transition metal-containing salts), U.S. Pat. No. 4,430,243 (chelants with manganese cations and non-catalytic metal cations), and U.S. Pat. No. 4,728,455 (manganese gluconate catalysts).

Preferred are cobalt catalysts which have the formula:

$$[Co(NH_3)_n(M')_m]Y_y$$

wherein n is an integer from 3 to 5 (preferably 4 or 5; most preferably 5); M' is a labile coordinating moiety, preferably selected from the group consisting of chlorine, bromine, hydroxide, water, and (when m is greater than 1) combinations thereof, m is an integer from 1 to 3 (preferably 1 or 2; most preferably 1); m+n=6; and Y is an appropriately selected counteranion present in a number y, which is an integer from 1 to 3 (preferably 2 to 3; most preferably 2 when Y is a −1 charged anion), to obtain a charge-balanced salt.

The preferred cobalt catalyst of this type useful herein are cobalt pentylamine chloride salts having the formula $[Co(NH_3)_5Cl]\ Y_y$, and especially $[Co(NH_3)_5Cl]Cl_2$.

More preferred are the present invention compositions which utilize cobalt (III) bleach catalysts having the formula:

$$[Co(NH_3)_n(M)_m(B)_b]T_y$$

wherein cobalt is in the +3 oxidation state; n is 4 or 5 (preferably 5); M is one or more ligands coordinated to the cobalt by one site; m is 0, 1 or 2 (preferably 1); B is a ligand coordinated to the cobalt by two sites; b is 0 or 1 (preferably 0), and when b=0, then m+n=6, and when b=1, then m=0 and n=4; and T is one or more appropriately selected counteranions present in a number y, where y is an integer to obtain a charge-balanced salt (preferably y is 1 to 3; most preferably 2 when T is a −1 charged anion); and wherein further said catalyst has a base hydrolysis rate constant of less than 0.23 $M^{-1}\ s^{-1}$ (25° C.).

Preferred T are selected from the group consisting of chloride, iodide, $I_3$−, formate, nitrate, nitrite, sulfate, sulfite, citrate, acetate, carbonate, bromide, $PF_6$−, $BF_4$−, $B(Ph)_4$−, phosphate, phosphite, silicate, tosylate, methanesulfonate, and combinations thereof. Optionally, T can be protonated if more than one anionic group exists in T, e.g., $HPO_4^{2}$—, $HCO_3$—, $H_2PO_4$−, etc. Further, T may be selected from the group consisting of non-traditional inorganic anions such as anionic surfactants (e.g., linear alkylbenzene sulfonates (LAS), alkyl sulfates (AS), alkylethoxysulfonates (AES), etc.) and/or anionic polymers (e.g., polyacrylates, polymethacrylates, etc.).

The M moieties include, but are not limited to, for example, F−, $SO_4^{-2}$, NCS-, SCN-, $SO_2O_3^{-2}$, $NH_3$, $PO_4^{3}$−, and carboxylates (which preferably are mono-carboxylates, but more than one carboxylate may be present in the moiety as long as the binding to the cobalt is by only one carboxylate per moiety, in which case the other carboxylate in the M moiety may be protonated or in its shalt form). Optionally, M can be protonated if more than one anionic group exists in M (e.g., $HPO_4^{2-}$, $HCO_3^{-}$, $H_2PO_4$−, $HOC(O)CH_2C(O)O$—, etc.) Preferred M moieties are substituted and unsubstituted $C_1$–$C_{30}$ carboxylic acids having the formulas:

$$RC(O)O—$$

wherein R is preferably selected from the group consisting of hydrogen and $C_1$–$C_{30}$ (preferably $C_1$–$C_{18}$) unsubstituted and substituted alkyl, $C_6$–$C_{30}$ (preferably $C_6$–$C_{18}$) unsubstituted and substituted aryl, and $C_3$–$C_{30}$ (preferably $C_5$–$C_{18}$) unsubstituted and substituted heteroaryl, wherein substituents are selected from the group consisting of —$NR'_3$, —$NR'^{+}_4$, —C(O)OR', —OR', —$C(O)NR'_2$, wherein R' is selected from the group consisting of hydrogen and $C_1$–$C_6$ moieties. Such substituted R therefore include the moieties —$(CH_2)_nOH$ and —$(CH_2)_nNR'^{+}_4$, wherein n is an integer from 1 to about 16, preferably from about 2 to about 10, and most preferably from about 2 to about 5.

Most preferred M are carboxylic acids having the formula above wherein R is selected from the group consisting of hydrogen, methyl, ethyl, propyl, straight or branched $C_4$–$C_{12}$ alkyl, and benzyl. Most preferred R is methyl. Preferred carboxylic acid M moieties include formic, benzoic, octanoic, nonanoic, decanoic, dodecanoic, malonic, maleic, succinic adipic, phthalic, 2-ethylhexanoic, naphthenoic, oleic, palmitic, triflate, tartrate, stearic, butyric, citric, acrylic, aspartic, fumaric, lauric, linoleic, lactic, malic, and especially acetic acid.

The B moieties include carbonate, di- and higher carboxylates (e.g., oxalate, malonate, malic, succinate, maleate), picolinic acid, and alpha and beta amino acids (e.g., glycine, alanine, beta-alanine, phenylalanine).

Cobalt bleach catalysts useful herein are known, being described for example along with their base hydrolysis rates, in M. L. Tobe, "Base Hydrolysis of Transition-Metal Complexes", *Adv. Inorg. Bioinorg. Mech.,* (1983), 2, pages 1–94. For example, Table 1 at page 17, provides the base hydrolysis rates (designated therein as $k_{OH}$) for cobalt pentaamine catalysts complexed with oxalate ($k_{OH}$=2.5 $\times 10^{-4}$ $M^{-1}$ $s^{-1}$(25° C.)), NCS–($k_{OH}$=5.0$\times 10^{-4}$ $M^{-1}$ $s^{-1}$ (25° C.)), formate ($k_{OH}$=5.8$\times 10^{-4}$ $M^{-1}$ $s^{-1}$ (25° C.)), and acetate ($k_{OH}$=9.6$\times 10^{-4}$ $M^{-1}$ $s^{-1}$ (25° C.)). The most preferred cobalt catalyst useful herein are cobalt pentaamine acetate salts having the formula $[Co(NH_3)_5OAc]$ $T_y$ , wherein OAc represents an acetate moiety, and especially cobalt pentaamine acetate chloride, $[Co(NH_3)_5OAc]Cl_2$; as well as $[Co(NH_3)_5OAc](OAc)_2$; $[Co(NH_3)_5OAc](PF_6)_2$; $[Co(NH_3)_5OAc](SO_4)$; $[Co(NH_3)_5OAc](BF_4)_2$; and $[Co(NH_3)_5OAc](NO_3)_2$.

Cobalt catalysts according to the present invention made be produced according to the synthetic routes disclosed in U.S. Pat. Nos. 5,559,261, 5,581,005, and 5,597,936, the disclosures of which are herein incorporated by reference.

These catalysts may be co-processed with adjunct materials so as to reduce the color impact if desired for the aesthetics of the product, or to be included in enzyme-containing particles as exemplified hereinafter, or the compositions may be manufactured to contain catalyst "speckles".

As a practical matter, and not by way of limitation, the cleaning compositions and cleaning processes herein can be adjusted to provide on the order of at least one part per hundred million of the active bleach catalyst species in the aqueous washing medium. and will preferably provide from about 0.01 ppm to about 25 ppm, more preferably from about 0.05 ppm to about 10 ppm, and most preferably from about 0.1 ppm to about 5 ppm, of the bleach catalyst species in the wash liquor. In order to obtain such levels in the wash liquor of an automatic dishwashing process, typical automatic dishwashing compositions herein will comprise from about 0.0005% to about 0.2%. more preferably from about 0.004% to about 0.08%, of bleach catalyst by weight of the cleaning compositions.

Detersive Enzymes

The compositions of the present invention may also include the presence of at least one detersive enzyme. "Detersive enzyme", as used herein, means any enzyme having a cleaning, stain removing or otherwise beneficial effect in a composition. Preferred detersive enzymes are hydrolases such as proteases, amylases and lipases. Highly preferred for automatic dishwashing are amylases and/or proteases, including both current commercially available types and improved types which, though more bleach compatible, have a remaining degree of bleach deactivation susceptibility.

In general, as noted, preferred compositions herein comprise one or more detersive enzymes. If only one enzyme is used, it is preferably an amyloytic enzyme when the composition is for automatic dishwashing use. Highly preferred for automatic dishwashing is a mixture of proteolytic enzymes and amyloytic enzymes. More generally, the enzymes to be incorporated include proteases, amylases, lipases, cellulases, and peroxidases, as well as mixtures thereof. In particular, mixtures of two or more protease enzymes and/or two or more amylase enzymes are preferred. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders, etc. In this respect bacterial or fungal enzymes are preferred, such as bacterial amylases and proteases, and fungal cellulases.

Enzymes are normally incorporated in the instant detergent compositions at levels sufficient to provide a "cleaning-effective amount". The term "cleaning-effective amount" refers to any amount capable of producing a cleaning, stain removal or soil removal effect on substrates such as fabrics, dishware and the like. Since enzymes are catalytic materials, such amounts may be Very small. In practical terms for current commercial preparations, typical amounts are up to about 5 mg by weight, more typically about 0.01 mg to about 3 mg, of active enzyme per gram of the composition. Stated otherwise, the compositions herein will typically comprise from about 0.001% to about 6%, preferably 0.01% –1% by weight of a commercial enzyme preparation. Protease enzymes are usually present in such commercial preparations at levels sufficient to provide from, 0.005 to 0.1 Anson units (AU) of activity per gram of composition. For automatic dishwashing, purposes, it may be desirable to increase the active enzyme content of the commercial preparations, in order to minimize the total amount of non-catalytically active materials delivered and thereby improve spotting/filming, results.

Suitable examples of proteases are the subtilisins which are obtained from particular strains of *B. subtilis* and *B. licheniformis.* Another suitable protease is obtained from a strain of Bacillus, having maximum activity throughout the pH range of 8–12, developed and sold bog Novo Industries A/S as ESPERASE®. The preparation of this enzyme and analogous enzymes is described in British Patent Specification No. 1,243,784 of Novo. Proteolytic enzymes suitable for removing protein-based stains that are commercially available include those sold under the tradenames ALCALASE®, DURAZYM® and SAVINASE® from Novo and MANATASE®, MAXACAL®, PROPERASE®, PURAFECT® and MAXAPEM ® (protein engineered Maxacal) from Genencor. Other proteases include Protease A (see European Patent Application 130,756, published Jan. 9, 1985) and Protease, B (see European Patent Application Ser. No. 87303761.8, filed Apr. 28, 1987, and European Patent Application No. 130,756, Bott et al, published Jan. 9, 1985).

An especially preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens* subtilisin, as described in WO 95/10615 published Apr. 20, 1995 by Genencor International, and U.S. Pat. Nos. 5,677,272 and 5,679,630.

Other preferred protease enzymes include protease enzymes which are a carbonyl hydrolase variant having an amino acid sequence not found in nature, which is derived by replacement of a plurality of amino acid residues of a precursor carbonyl hydrolase with different amino acids, wherein said plurality of amino acid residues replaced in the precursor enzyme correspond to position; +210 in combination with one or more of the following residues: +33, +62, +67, +76, +100, +101, 103, +104, +107, +128, +129, +130, +132, +135, +156, +158, +164, +166, +167, +170, +209, +215, +217, +218 and +222, where the numbered positions correspond to naturally-occurring, subtilisin from *Bacillus amyloliquefaciens* or to equivalent amino acid residues in other carbonyl hydrolases or subtilisins (such as *Bacillus lentus* subtilisin). Preferred enzymes according include those having position changes +210, +76, +103, +104, +156, and +166.

Useful proteases are also described in PCT publications: WO 95/30010 published Nov. 9, 1995 by The Procter & Gamble Company; WO 95/30011 published Nov. 9, 1995 by The Procter & Gamble Company; WO 95/29979 published Nov. 9, 1995 by The Procter & Gamble Company.

Amylases suitable herein include, for example, (α-amylases described in British Patent Specification No. 1,296,839 (Novo), RAPIDASE®, International Bio-Synthetics, Inc. and TERMAMYL®, Novo Industries, PURAFECT Ox Am® from Genencor and Ban® , Fungamyl® and Duramyl®, Preferred amylases herein have the commonalty of being derived using site-directed mutagenesis from one or more of the Baccillus amylases, especially the Bacillus alpha-amylases, regardless of whether one, two or multiple amylase strains are the immediate precursors.

As noted, "oxidative stability-enhanced" amylases are preferred for use herein despite the fact that the invention makes them "optional but preferred" materials rather than essential. Such amylases are non-limitingly illustrated by the following:

(a) An amylase according to the hereinbefore incorporated WO/94/02597, Novo Nordisk A/S, published Feb. 3, 1994, as further illustrated by a mutant in which substitution is made, using alanine or threonine (preferably threonine), of the methionine residue located in position 197 of the *B. licheniformis* alpha-amylase, known as TERMAMYL®, or the homologous position variation of a similar parent amylase, such as *B. amylolyoliquefacieis, B. subtilis,* or *B. stearothermophilus;*

(b) Stability-enhanced amylases as described by Genencor International in a paper entitled "Oxidatively Resistant alpha-Amylases" presented at the 207th American Chemical Society National Meeting, Mar. 13–17 1994, by C. Mitchinson. Therein it was noted that bleaches in automatic dishwashing detergents inactivate alpha-amylases but that improved oxidative stability amylases have been made by Genencor from *B. licheniformis* NCIB8061. Methionine (Met) was identified as the most likely residue to be modified. Met was substituted, one at a time, in positions 8, 15, 197, 256, 304, 366 and 438 leading to specific mutants, particularly important being M197L and M197T with the M 197T variant,being the most stable expressed variant. Stability was measured in CASCADE® and SUNLIGHT®;

(c) Particularly preferred are amylase variants as disclosed in WO095/26397 and in the co-pending application to Novo Nordisk PCT/DK96/00056 now WO 96/23873 and characterized by having a specific activity at least 25% higher than the specific activity of Termamyl® at a temperature range of 25° C. to 55° C. and at a pH value in the range of 8 to 10, measured by the Phadebas® α-amylase activity assay and is obtained from an alkalophilic Bacillus species (such as the strains NCIB 12289, NCIB 12512, NCIB 12513 and DSM 935) comprising the following amino acid sequence in the N-terminal: His-His-Asn-Gly-Thr-Asn-Gly-Thr-Met-Met-Gln-Tyr-Phe-Glu-Trp-Tyr-Leu-Pro-Asn-Asp.

Cellulases usable in, but not preferred, for the present invention include both bacterial or fungal cellulases. Typically they will have a pH optimum of between 5 and 9.5. Suitable cellulases are disclosed in U.S. Pat. No. 4,435,307, Barbesgoard et al, issued Mar. 6, 1984, which discloses fungal cellulase produced from *Humicola insolens* and Humicola strain DSM1800 or a cellulase 212-producing fungus belonging to the genus Aeromonas, and cellulase extracted from the hepatopancreas of a marine mollusk (*Dolabella Auricula Solander*). Suitable cellulases are also disclosed in GB-A-2.075.028; GB-A-2.095.275 and DE-OS-2.247.832. CAREZYME® (Novo) is especially useful.

Suitable lipase enzymes for detergent use include those produced by microorganisms of the Pseudomonas group, such as *Pseudomonas stutzeri* ATCC 19,154, as disclosed in British Patent No. 1,372,034. See also lipases in Japanese Patent Application No. 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex *Chromobacter viscosum,* e.g. *Chromobacter viscosum var. lipolyticum* NRRLB 3673, commercially available from Toyo Jozo Co., Tagata, Japan: and further *Chromobacter viscosum* lipases from U.S. Biochemical Corp., U.S.A. and Disoynth Co., The Netherlands, and lipases ex *Pseudomonas gladioli.* The LIPOLASE® enzyme derived from *Humicola lanuginosa* and commercially available from Novo (see also EPO 341,947) is a preferred lipase for use herein. Another preferred lipase enzyme is the D96L variant of the native Humicola lanuginosa lipase, as described in WO 92/05249 and Research Disclosure No. 35944, Mar. 10, 1994, both published by Novo. In general, lipolytic enzymes are less preferred than amylases and/or proteases for automatic dishwashing embodiments of the present invention.

Peroxidase enzymes can be used in combination with oxygen sources. e.g., percarbonate, perborate, persulfate, hydrogen peroxide, etc. They are typically used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S. The present invention encompasses peroxidase-free automatic dishwashing composition embodiments.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457. Place et al., issued Jul. 18, 1978, and in U.S. Pat. No. 4,507,219, Hughes, issued Mar. 26, 1985. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

Disrupting Agents

The detergent tablet of the present invention may further comprise a disrupting agent. Disrupting agents are typically included in the tablet at levels of from about 5% to about 60% and more preferably from about 20% to about 50%. The disrupting agent may be a disintegrating or effervescing agent. Preferably, the disrupting agents of the present invention will be included in the gelatinous portion. Suitable disintegrating agents include agents that swell on contact with water or facilitated water influx and/or efflux by forming channels in compressed and/or non-compressed portions. Any known disintegrating or effervescing agent suitable for use in laundry or dishwashing applications is envisaged for use herein. Suitable disintegrating agent include starch, starch derivatives, alginates, carboxymethylcellulose (CMC), CMC-based polymers, sodium acetate, aluminium oxide. Other optional disrupting aids include organic and inorganic acids such as maleic acid, malic acid, hydrochloric acid, sodium hydroxide and layered silicates. Suitable effervescing agents are those that produce a gas on contact with water. Suitable effervescing agents may be oxygen, nitrogen dioxide or carbon dioxide evolving species. Examples of preferred effervescing agents may be selected from the group consisting of perborate, percarbonate, carbonate, bicarbonate and carboxylic acids such as citric or maleic acid.

pH and Buffering Variation

Many detergent compositions herein will be buffered i.e., they are relatively resistant to pH drop in the presence of acidic soils. However, other compositions herein may have exceptionally low buffering capacity, or may be substantially unbuffered. Techniques for controlling or varying pH at recommended usage levels more generally include the use of not only buffers, but also additional alkalis, acids, pH-jump systems, dual compartment containers, etc., and are well known to those skilled in the art.

The preferred compositions herein comprise a pH-adjusting component selected from water-soluble alkaline inorganic salts and water-soluble organic or inorganic builders. The pH-adjusting components are selected so that when the composition is dissolved in water at a concentration of 1,000–10,000 ppm, the pH remains in the range of above about 6, preferably from about 9.5 to about 11.5. In fact, included in the present invention, is a detergent tablet wherein varying pH can be achieved in the wash process. For instance, the gel portion of the tablet may rapidly dissolve adjusting the pH to one level, for example, neutral to slightly basic or about 6.0 to about 8.0, followed by slower dissolution of the tablet body raising the pH to from about 9.5 to about 11.5 wherein the pH of the composition is altered to provide improved cleaning performance. The preferred nonphosphate pH-adjusting component of the invention is selected from the group consisting of:

(i) sodium carbonate or sesquicarbonate;
(ii) sodium silicate, preferably hydrous sodium silicate having $SiO_2$:$Na_2O$ ratio of from about 1:1 to about 2:1, and mixtures thereof with limited quantities of sodium metasilicate;
(iii) sodium citrate;
(iv) citric acid;
(v) sodium bicarbonate;
(vi) sodium borate, preferably borax;
(vii) sodium hydroxide; and
(viii) mixtures of (i)–(vii).

Preferred embodiments contain low levels of silicate (i.e. from about 3% to about 10% $SiO_2$).

The amount of the pH adjusting component in the instant composition is preferably from about 1% to about 50%, by weight of the composition. In a preferred embodiment, the pH-adjusting component is present in the composition in an amount from about 5% to about 40%, preferably from about 10% to about 30%, by weight.

Water-Soluble Silicates

The present compositions may further comprise water-soluble silicates. Water-soluble silicates herein are any silicates which are soluble to the extent that they do not adversely affect spotting/filming characteristics of the ADD composition.

Examples of silicates are sodium metasilicate and, more generally, the alkali metal silicates, particularly those having a $SiO_2Na_2O$ ratio in the range 1.6:1 to 3.2:1; and layered silicates such as the layered sodium silicates described in U.S. Pat. No. 4,664,839, issued May 12, 1987 to H. P. Rieck. NaSKS-6® is a crystalline layered silicate marketed by Hoechst (commonly abbreviated herein as "SKS-6"). Unlike zeolite builders, Na SKS-6 and other water-soluble silicates useful herein do not contain aluminum. NaSKS-6 is the $\delta$-$Na_2SiO_5$ form of layered silicate and can be prepared by methods such as those described in German DE-A-3,417,649 and DE-A-3,742,043. SKS-6 is a preferred layered silicate for use herein, but other such layered silicates, such as those having the general formula $NaMSi_xO_{2x+1}\cdot yH_2O$ wherein M is sodium or hydrogen, x is a number from 1.9 to 4, preferably 2, and y is a number from 0 to 20, preferably 0 can be used. Various other layered silicates from Hoechst include NaSKS-5, NaSKS-7 and NaSKS-11, as the $\alpha$, $\beta$- and $\gamma$-forms. Other silicates may also be useful, such as for example magnesium silicate, which can serve as a crispening agent in granular formulations, as a stabilizing agent for oxygen bleaches, and as a component of suds control systems.

Silicates particularly useful in automatic dishwashing (ADD) applications include granular hydrous 2-ratio silicates such as BRITIESII® H20 from PQ Corp., and the commonly sourced BRITIESII® H24 though liquid grades of various silicates can be used when the ADD composition has liquid form. Within safe limits, sodium metasilicate or sodium hydroxide alone or in combination with other silicates may be used in an ADD context to boost wash pH to a desired level.

Chelating Agents

The compositions herein may also optionally contain one or more transition-metal selective sequestrants, "chelants" or "chelating agents", e.g., iron and/or copper and/or manganese chelating agents. Chelating agents suitable for use herein can be selected from the group consisting of aminocarboxylates, phosphonates (especially the amilloplhosphonates), polyfunctionally-substituted aromatic chelating agents, and mixtures thereof. Without intending to be bound by theory, it is believed that the benefit of these materials is due in part to their exceptional ability to control iron, copper and manganese in washing solutions which are known to decompose hydrogen peroxide and/or bleach activators; other benefits include inorganic film prevention or scale inhibition. Commercial chelating agents for use herein include the DEQUEST® series. and chelants from Monsanto, DuPont, and Nalco, Inc.

Aminocarboxylates useful as optional chelating agents are further illustrated by ethylenediaminetetraacetate, N-hydroxyethylethylenediaminetriacetates, nitrilotriacetates, ethylenediamine tetraproprionates, triethylenetetraaminehexacetates, diethylenetriaminepenitaacetates, and ethanoldiglycinies, alkali metal, ammonium, and substituted ammonium salts thereof. In general, chelant mixtures may be used for a combination of functions, such as multiple transition-metal control, long-term product stabilization, and/or control of precipitated transition metal oxides and/or hydroxides.

Polyfunctionally-substituted aromatic chelating agents are also useful in the compositions herein. See U.S. Pat. No.

3,812,044, issued May 21, 1974, to Connor et al. Preferred compounds of this type in acid form are dihydroxydisulfobenzenes such as 1,2-dihydroxy-3,5-disulfobenzene.

A highly preferred biodegradable chelator for use herein is ethylenediamine disuccinate ("EDDS"), especially (but not limited to) the [S,S] isomer as described in U.S. Pat. No. 4,704,233, Nov. 3, 1987, to Hartman and Perkins. The trisodium salt is preferred though other forms, such as magnesium salts, may also be useful.

Aminophosphonates are also suitable for use as chelating agents in the compositions of the invention when at least low levels of total phosphorus are acceptable in detergent compositions, and include the ethylenediaminetetrakis (methylenephosphonates) and the diethylenetriaminepentakis (methylene phosphonates). Preferably, these aminophosphonates do not contain alkyl or alkenyl groups with more than about 6 carbon atoms.

If utilized, chelating agents or transition-metal-selective sequestrants will preferably comprise from about 0.001% to about 10%, more preferably from about 0.050/) to about 1/), by weight of the compositions herein.

Organic Polymeric Compound

Organic polymeric compounds may be added as preferred components of the detergent tablets in accord with the invention. By organic polymeric compound it is meant essentially any polymeric organic compound commonly found in detergent compositions having dispersant anti-redeposition, soil release agents or other detergency properties.

Organic polymeric compound is typically incorporated in the detergent compositions of the invention at a level of from 0.1% to 300%, preferably from 0.5% to 15%, most preferably from 1% to 10% by weight of the compositions.

Examples of organic polymeric compounds include the water soluble organic homo- or co-polymeric polycarboxylic acids, modified polycarboxylates or their salts in which the polycarboxylic acid comprises at least two carboxyl radicals separated from each other by not more than two carbon atoms. Polymers of the latter type are disclosed in GB-A-1,596,756. Examples of such salts are polyacrylates of molecular weight 2000–10000 and their copolymers with any suitable other monomer units including modified acrylic, fumaric, maleic, itaconic, aconitic, mesaconic, citraconic and methylenemalonic acid or their salts, maleic anhydride, acrylamide, alkylene, vinylmethyl ether, styrene and any mixtures thereof. Preferred are the copolymers of acrylic acid and maleic anhydride having a molecular weight of from 20,000 to 100,000.

Preferred commercially available acrylic acid containing polymers having a molecular weight below 15,000 include those sold under the tradename Sokalan PA30, PA20, PA15, PA10 and Sokalan CP10 by BASF GmbH, and those sold under the tradename Acusol 45N, 480N, 460N by Rohm and Haas.

Preferred acrylic acid containing copolymers include those which contain as monomer units: a) from 90% to 10%, preferably from 80% to 20% by weight acrylic acid or its salts and b) from 10% to 90%, preferably from 20% to 80% by weight of a substituted acrylic monomer or its salts having the general formula —[$CR_2$—$CR_1$ (CO—O—$R_3$)]— wherein at least one of the substituents $R_1$, $R_2$ or $R_3$, preferably $R_1$ or $R_2$ is a 1 to 4 carbon alkyl or hydroxyalkyl group, $R_1$ or $R_2$ can be a hydrogen and $R_3$ can be a hydrogen or alkali metal salt. Most preferred is a substituted acrylic monomer wherein $R_1$ is methyl, $R_2$ is hydrogen (i.e. a methacrylic acid monomer). The most preferred copolymer of this type has a molecular weight of 3500 and contains 60% to 80% by weight of acrylic acid and 40% to 20% by weight of methacrylic acid.

The polyamine and modified polyamine compounds are useful herein including those derived from aspartic acid such as those disclosed in EP-A-305282, EP-A-305283 and EP-A-351629.

Other optional polymers may polyvinyl alcohols and acetates both modified and non-modified, cellulosics and modified cellulosics, polyoxyethylenes, polyoxypropylene, and copolymers thereof, both modified and non-modified, terephthalate esters of ethylene or propylene glycol or mixtures thereof with polyoxyalkylene units.

Suitable examples are disclosed in US Pat. Nos. 5.591, 703, 5,597,789 and 4,490,271.

Material Care Agents

The present compositions may contain one or more material care agents which are effective as corrosion inhibitors and/or anti-tarnish aids. Such materials are preferred components of machine dishwashing compositions especially in certain European countries where the use of electroplated nickel silver and sterling silver is still comparatively common in domestic flatware, or when aluminum protection is a concern and the composition is low in silicate. Generally, such material care agents include metasilicate, silicate, bismuth salts, manganese salts, paraffin, triazoles, pyrazoles, thiols, mercaptans, aluminum fatty acid salts, and mixtures thereof.

When present, such protecting materials are preferably incorporated at low levels. e.g., from about 0.01% to about 5% of the ADD composition. Suitable corrosion inhibitors include paraffin oil, typically a predominantly branched aliphatic hydrocarbon having a number of carbon atoms in the range of from about 20 to about 50; preferred paraffin oil is selected from predominantly branched $C_{25-45}$ species with a ratio of cyclic to noncyclic hydrocarbons of about 32:68. A paraffin oil meeting those characteristics is sold by Wintershall, Salzbergen, Germany, under the trade name WINOG 70. Additionally, the addition of low levels of bismuth nitrate (i.e., $Bi(NO_3)_3$) is also preferred.

Other corrosion inhibitor compounds include benzotriazole and comparable compounds; mercaptans or thiols including thionaphtol and thioanthranol; and finely divided Aluminum fatty acid salts, such as aluminum tristearate. The formulator will recognize that such materials will generally be used judiciously and in limited quantities so as to avoid any tendency to produce spots or films on glassware or to compromise the bleaching action of the compositions. For this reason, mercaptan anti-tarnishes which are quite strongly bleach-reactive and common fatty carboxylic acids which precipitate with calcium in particular are preferably avoided.

Silicone and Phosphate Ester Suds Suppressors

The compositions of the invention can optionally contain an alkyl phosphate ester suds suppressor, a silicone suds suppressor, or combinations thereof. Levels in general are from 0% to about 10%, preferably, from about 0.001% to about 5%. However, generally (for cost considerations and/or deposition) preferred compositions herein do not comprise suds suppressors or comprise suds suppressors only at low levels, e.g., less than about 0.1% of active suds suppressing agent.

Silicone suds suppressor technology and other defoaming agents useful herein are extensively documented in "Defoaming, Theory and Industrial Applications", Ed., P. R. Garrett, Mareel Dekker, N.Y. 1973, ISBN 0-8247-8770-6, incorporated herein by reference. See especially the chapters entitled "Foam control in Detergent Products" (Ferch et al)

and "Surfactant Antifoams" (Blease et al). See also U.S. Pat. Nos. 3,933,672 and 4,136,045. Highly preferred silicone suds suppressors are the compounded types known for use in laundry deterrents such as heavy-duty granules, although types hitherto used only in heavy-duty liquid detergents may also be incorporated in the instant compositions. For example, polydimethylsiloxanes having trimethylsilyl or alternate endblocking units may be used as the silicone. These may be compounded with silica andlor with surface-active nonsilicon components, as illustrated by a suds suppressor comprising 1% silicone/silica, 18% stearyl alcohol and 70% starch in granular form. A suitable commercial source of the silicone active compounds is Dow Corning Corp.

If it is desired to use a phosphate ester, suitable compounds are disclosed in U.S. Pat. No. 3,314,891, issued Apr. 18, 1967, to Schmolka et al, incorporated herein by reference. Preferred alkyl phosphate esters contain from 16–20 carbon atoms. Highly preferred alkyl phosphate esters are monostearyl acid phosphate or monooleyl acid phosphate, or salts thereof, particularly alkali metal salts, or mixtures thereof.

It has been found preferable to avoid the use of simple calcium-precipitating soaps as antifoams in the present compositions as they tend to deposit on the dishware. Indeed, phosphate esters are not entirely free of such problems and the formulator will generally choose to minimize the content of potentially depositing antifoams in the instant compositions.

Adjunct Materials

Detersive ingredients or adjuncts optionally included in the instant compositions can include one or more materials for assisting or enhancing cleaning performance, treatment of the substrate to be cleaned, or designed to improve the aesthetics of the compositions. Adjuncts which can also be included in compositions of the present invention, at their conventional art-established levels for use (generally, adjunct materials comprise, in total, from about 30% to about 99.9%, preferably from about 70% to about 95%, by weight of the compositions), include other active ingredients such as non-phosphate builders, chelants, enzymes, suds suppressors, dispersant polymers (e.g., from BASF Corp. or Rohm & Haas), color speckles, silvercare, anti-tarnish and/or anti-corrosion agents, silicates, dyes fillers, germicides, alkalinity sources, hydrotropes, anti-oxidants, enzyme stabilizing agents, perfumes, solubilizing agents, carriers, processing aids, pigments, and pH control agents.

Depending on whether a greater or lesser degree of compactness is required, filler materials can also be present in the instant compositions. These include sucrose, sucrose esters, sodium sulfate, potassium sulfate, etc., in amounts up to about 70%, preferably from 0% to about 40% of the composition. Preferred filler is sodium sulfate, especially in good grades having at most low levels of trace impurities.

Sodium sulfate used herein preferably has a purity sufficient to ensure it is non-reactive With bleach; it may also be treated with low levels of sequestrants, such as phosphonates or EDDS in magnesium-salt form. Note that preferences, in terms of purity sufficient to avoid decomposing bleach, applies also to pH-adjusting component ingredients, specifically including any silicates used herein.

Hydrotrope materials such as sodium benzene sulfonate, sodium toluene sulfonate, sodium cumene sulfonate, etc., can be present, e.g., for better dispersing surfactant.

Bleach-stable perfumes (stable as to odor); and bleach-stable dyes such as those disclosed in U.S. Pat. No. 4,714,562, Roselle et al, issued Dec. 22, 1987 can also be added to the present compositions in appropriate amounts.

Since the compositions herein can contain water-sensitive ingredients or ingredients which can co-react when brought together in an aqueous environment, it is desirable to keep the free moisture content at a minimum, e.g., 7% or less, preferably 5% or less of the compositions; and to provide packaging which is substantially impermeable to water and carbon dioxide. Coating measures have been described herein to illustrate a way to protect the ingredients from each other and from air aid moisture. Plastic bottles, including refillable or recyclable types, as well as conventional barrier cartons or boxes are another helpful means of assuring maximum shelf-storage stability. As noted, when ingredients are not highly compatible, it may further be desirable to coat at least one such ingredient with a low-foaming nonionic surfactant for protection. There are numerous waxy materials which can readily be used to form suitable coated particles of any such otherwise incompatible components; however, the formulator prefers those materials which do not have a marked tendency to deposit or form films on dishes including those of plastic construction.

Process

The detergent tablets of the present invention are prepared by separately preparing the composition of active detergent components forming the respective compressed portion and the non-compressed, gel portion, forming the compressed body portion and delivering or adhering the gel portion to the compressed portion.

The compressed portion is prepared by obtaining at least one active detergent component and optionally premixing with carrier components. Any pre-fixing will be carried out in a suitable mixer; for example a pan mixer, rotary drum, vertical blender or high shear mixer or by other suitable conventional means such as agglomeration. Preferably dry particulate components are admixed in a mixer, as described above, and liquid components are applied to the dry particulate components, for example by spraying the liquid components directly onto the dry particulate components. The resulting composition is then formed into a compressed portion in a compression step using any known suitable equipment. Preferably the composition is formed into a compressed portion using a tablet press, wherein the tablet is prepared by compression of the composition between an upper and a lower punch. In a preferred embodiment of the present invention the composition is delivered into a punch cavity of a tablet press and compressed to form a compressed portion using a pressure of preferably greater than 6.3 $KN/cm^2$, more preferably greater than 9 $KN/cm^2$, most preferably greater than 10.8 $KN/cm^2$.

In order to form a preferred tablet of the invention, wherein the compressed portion provides an indentation or mold to receive the non-compressed, gel portion, the compressed portion is prepared using a modified tablet press comprising modified upper and/or lower punches. The upper and lower punches of the modified tablet press are modified such that the compressed portion provides one or more indentations which form the mold(s) to which the non-compressed, gel portion is delivered.

As described in detail herein before, the non-compressed, gel portion comprises at least one active detergent component. The active detergent component, thickening system and any other ingredients in the gel portion are pre-mixed using any known suitable mixing equipment. Once prepared, the gel portion is delivered as a flowable, pumpable gel to the compressed portion in metered amounts. The gel portion is then allowed to harden or thicken on the compressed body portion.

The detergent tablets may be employed in any conventional domestic washing process wherein detergent tablets are commonly employed, including but not limited to automatic dishwashing and fabric laundering.

The following non limiting examples further illustrate the present invention.

Abbreviations Used in Examples

In the detergent compositions. the abbreviated component identifications have the following meanings:

| | |
|---|---|
| STPP | Sodium tripolyphosphate |
| Citrate | Tri-sodium citrate dihydrate |
| Bicarbonate | Sodium hydrogen carbonate |
| Citric Acid | Anhydrous Citric acid |
| Carbonate | Anhydrous sodium carbonate |
| Silicate | Amorphous Sodium Silicate ($SiO_2$:$Na_2O$ ratio = 1.6–3.2) |
| Metasilicate | Sodium metasilicate ($SiO_2$:$Na_2O$ ratio = 1.0) |
| PB1 | Anhydrous sodium perborate monohydrate |
| PB4 | Sodium perborate tetrahydrate of nominal formula $NaBO_2.3H_2O.H_2O_2$ |
| TAED | Tetraacetyl ethylene diamine |
| HEDP | Ethane 1-hydroxy-1,1-diphosphonic acid |
| DETPMP | Diethyltriamine penta (methylene) phosphonate, marketed by Monsanto under the tradename Dequest 2060 |
| PAAC | Pentaamine acetate cobalt (III) salt |
| Paraffin | Paraffin oil sold under the tradename Winog 70 by Wintershall. |
| Protease | Proteolytic enzyme |
| Amylase | Amylolytic enzyme. |
| BTA | Benzotriazole |
| PA30 | Polyacrylic acid of average molecular weight approximately 4,500 |
| pH | Measured as a 1% solution in distilled water at 20° C. |

EXAMPLE 1

A multi-layer detergent tablet according to the present invention may be prepared as follows. A detergent composition as in Example 29 formulation A is prepared and passed into a conventional rotary press. The press includes one punch shaped so that an indentation is formed into one of the tablet surfaces. A gel matrix formulation as disclosed in Example 2, formulation A is then prepared. The proper amount of non-aqueous solvent is provided to a mixer and shear is applied to the solvent at a moderate rate (500–5,000 rpm). The proper amount of gelling agent is gradually added to the solvent under shear conditions until the mixture is homogeneous. The shear rate of the mixture is gradually increased to high shear condition of around 10,000 rpm. The temperature of the mixture is increased to between 55° C. and 60° C. The shear is then stopped and the mixture is allowed to cool to temperatures between 40° C. and 45° C. Using a low shear mixer, the remaining ingredients are then added to the mixture as solids. The final mixture is then metered into the indentation on the compressed tablet body and allowed to stand until the gel hardens or is no longer flowable.

EXAMPLE 2

A multi-layer detergent tablet according to the present invention may be prepared as follows: A detergent composition as in Example 2, formulation A is prepared and passed into a conventional rotary press. The press includes one punch shaped so that an indentation is formed into one of the tablet surfaces. A gel matrix formulation as disclosed in Example 2, formulation A is then prepared. The proper amount of non-aqueous solvent is provided to a mixer where low shear is applied and the mixture is heated to about 50° C. The proper amount of gelling agent is gradually added to the solvent under stirring until dissolved. The temperature of the mixture or solution is allowed to cool down to between 25° C. and 35° C. Using low shear, the remaining ingredients are then added to the solution as solids. The final mixture is then metered into the indentation on the compressed tablet body and allowed to stand until the gel hardens or is no longer flowable.

EXAMPLE 3

Detergent Tablets according to the present invention may be formulated as follows:

| | A | B | C | D | E | F |
|---|---|---|---|---|---|---|
| Compressed portion | | | | | | |
| STPP | 52.80 | 55.10 | 51.00 | — | 50.00 | 38.20 |
| Citrate | — | — | — | 26.40 | — | — |
| Carbonate | 15.40 | 14.00 | 14.00 | — | 18.40 | 15.00 |
| Silicate | 12.60 | 14.80 | 15.00 | 26.40 | 10.00 | 10.10 |
| Protease | — | 1.00 | — | — | — | — |
| Amylase | 0.95 | 0.75 | 0.75 | 0.60 | 2.0 | 0.85 |
| PB1 | 12.60 | 12.50 | 12.50 | 1.56 | 15.70 | 11.00 |
| PB4 | — | — | — | 6.92 | — | — |
| Nonionic | 1.65 | 1.50 | 2.00 | 1.50 | 0.80 | 1.65 |
| PAAC | — | 0.016 | — | 0.012 | — | 0.008 |
| TAED | — | — | — | 4.33 | 1.30 | — |
| HEDP | — | — | — | 0.67 | — | 0.92 |
| DETPMP | — | — | — | 0.65 | — | — |
| Paraffin | — | 0.50 | 0.50 | 0.42 | — | — |
| BTA | — | 0.30 | 0.30 | 0.24 | — | — |
| PA30 | — | — | — | 3.20 | — | — |
| Perfume | 0.05 | — | — | — | 0.20 | 0.20 |
| Sulphate | — | — | — | 24.05 | 10.68 | 22.07 |
| Misc/water to balance | | | | | | |
| Weight (g) | 20.00 | 20.00 | 20.50 | 20.00 | | 30.00 |
| Non-compressed portion | | | | | | |
| Savinase ® | 12.80 | — | 10.00 | 4.50 | — | 4.00 |
| N76D/S103A/V104I[1] | — | 8.00 | — | 4.50 | 8.00 | 4.00 |
| Termamyl ® | 7.20 | — | 12.00 | 5.00 | — | — |

-continued

| | A | B | C | D | E | F |
|---|---|---|---|---|---|---|
| Amylase[2] | — | 13.00 | — | 5.00 | — | 13.00 |
| Bicarbonate | 24.00 | 13.00 | 11.50 | 13.00 | 6.00 | |
| Citric acid | 18.00 | 13.00 | 11.50 | 14.00 | 6.00 | |
| Dipropyleneglycol butylether | — | — | 50.00 | 40.00 | — | 35.00 |
| Glycerol Triacetate | 34.00 | 40.00 | — | — | 48.00 | — |
| Thixatrol ST ® | — | — | 5.00 | 7.00 | 4.00 | — |
| Polyethylene glycol[3] | 4.00 | 2.00 | — | — | — | 3.00 |
| Metasilicate | — | — | — | 7.00 | — | 41.00 |
| Silicate | — | 11.00 | — | — | 28.00 | — |
| Weight (g) | 3.50 | 3.00 | 3.50 | 3.00 | 5.00 | 5.00 |

[1]As disclosed in U.S. Pat. No. 5,677,272.
[2]Amylase enzyme as disclosed in Novo Nordisk application PCT/DK96/00056 now W096/23873 and is obtained from an alkalophilic Bacillus species having a N-terminal sequence of: His-His-Asn-Gly-Thr-Asn-Gly-Thr-Met-Met-Gln-Tyr-Phe-Glu-Trp-Tyr-Leu-Pro-Asn-Asp.
[3]MW 4,000–8,000.

What is claimed is:

1. A detergent tablet comprising:

a) a compressed solid body portion having at least one mold in said compressed body portion; and b) a non-compressed, gelatinous portion mounted in said mold of said compressed body portion;

wherein said gelatinous portion comprises a thickening system and at least one detergent active; wherein said gelatinous portion is formulated so that at least 80% of said detergent active is delivered to the wash within the first 5 minutes of a domestic wash process; and wherein at least 15% of said gelatinous portion is a suspended solid.

2. The detergent tablet as claimed in claim 1 wherein said gelatinous portion is formulated so that at least 90% of said detergent active is delivered to the wash within the first 3 minutes of a domestic wash process.

3. The detergent tablet as claimed in claim 1 wherein said detergent active of said gelatinous portion is selected from the group consisting of enzymes, surfactants, disrupting agents, bleaching agents, silver care agents, builders, and mixtures thereof.

4. The detergent tablet as claimed in claim 3 wherein said detergent active is an enzyme.

5. The detergent tablet as claimed in claim 3 wherein said detergent active is a disrupting agent.

6. The detergent tablet as claimed in claim 5 wherein said disrupting agent comprises a salt of carbonate or bicarbonate and an organic acid.

7. The detergent tablet as claimed in claim 1 wherein at least about 40% of said gelatinous portion is a suspended solid.

8. The detergent tablet as claimed in claim 1 wherein said gelatinous portion further includes a structure modifying agent.

9. The detergent tablet as claimed in claim 8 wherein said structure modifying agent is polyethylene oxide.

10. The detergent tablet as claimed in claim 1 wherein said thickening system comprises a mixture of a non-aqueous diluent and a gelling agent.

11. The detergent tablet as claimed in claim 10 wherein said gelling agent is selected from the group consisting of castor oil derivatives, polyvinylpyrrolidone, polyethylene glycol and mixtures thereof.

12. The detergent tablet as claimed in claim 10 wherein said non-aqueous diluent is selected from the group consisting of low molecular weight polyethylene glycols, glycerol and modified glycerols, propylene glycol, alkyleneglycol alkyl ethers, and mixtures thereof.

13. The detergent tablet as claimed in claim 11 wherein said gelling agent is a polyethylene glycol.

14. The detergent tablet as claimed in claim 11 wherein said gelling agent is a polyethylene glycol having a molecular weight of from about 4,000 to about 8,000.

15. The detergent tablet as claimed in claim 11 wherein said gelling agent is polyvinylpyrrolidone.

16. The detergent tablet as claimed in claim 12 wherein said non-aqueous diluent is propyleneglycol butylether, ethyleneglycol butyl ether, propylene glycol or glycerol triacetate.

17. The detergent tablet as claimed in claim 12 wherein said non-aqueous, diluent is dipropyleneglycol butylether.

18. The detergent tablet as claimed in claim 1 wherein the weight ratio of said compressed portion to said non-compressed gelatinous portion is greater than about 0.5:1 and said detergent tablet has a dissolution rate of greater than 0.33 glmin as determined using SOTAX dissolution test method.

* * * * *